United States Patent [19]

Grant

[11] Patent Number: 4,850,081

[45] Date of Patent: Jul. 25, 1989

[54] VARIABLE FRICTION HINGE

[76] Inventor: Alexander Grant, The Chimney's, Castletown, Caithness, Scotland

[21] Appl. No.: 152,094

[22] PCT Filed: May 13, 1987

[86] PCT No.: PCT/GB87/00328

§ 371 Date: Mar. 25, 1988

§ 102(e) Date: Mar. 25, 1988

[87] PCT Pub. No.: WO87/07320

PCT Pub. Date: Dec. 3, 1987

[30] Foreign Application Priority Data

May 27, 1986 [GB] United Kingdom ..... 8612857

[51] Int. Cl.[4] ..... E05D 7/086; E05D 7/10

[52] U.S. Cl. ..... 16/257; 16/266; 16/341

[58] Field of Search ..... 16/228, 257, 261, 262, 16/266, 267, 337, 341, 342, 352

[56] References Cited

U.S. PATENT DOCUMENTS 2,605,926 8/1952 Casey ..... 16/257 X
2,933,016 4/1960 Kunde et al. ..... 16/261 X
3,178,761 4/1965 Restaino .
3,488,667 1/1970 Guts Hall .
3,936,907 2/1976 Jansons ..... 16/257
4,333,206 6/1982 Lang .

FOREIGN PATENT DOCUMENTS 0013338 7/1980 European Pat. Off. .
3404511 8/1985 Fed. Rep. of Germany ..... 16/228
2140862 12/1984 United Kingdom .

*Primary Examiner*—Fred A. Silverberg
*Attorney, Agent, or Firm*—Lalos & Keegan

[57] ABSTRACT

A hinge comprises first and second components (10,12) for attachment to respective structural members. A substantially cylindrical surface (26) on the second component (12) snap-fits into a part-cylindrical bearing surface (20) on the first component (10). The components (10,12) have interengaging formations which act to resist closing over a predetermined arc. In one embodiment, one set of interengaging formations comprises blades (28) sliding in slots (22), and another set comprises protrusions (32,34).

5 Claims, 3 Drawing Sheets

VARIABLE FRICTION HINGE

This invention relates to hinges.

The invention is particularly but not exclusively concerned with hinges for use in applications such as the lid of a chest-type freezer. In such applications it is desired to provide a hinge which will allow the lid to be lifted to an open position and will retain the lid in that position until it is positively closed by the user. It is also desirable that the user may open the lid to any selected angle within a range of opening angles. These objects have conventionally been met by the use of a metal hinge comprising two body components, a hinge pin, and a counterpoise torsion spring. Such an arrangement is expensive and complex to assemble.

It is therefore an object of the present invention to provide a hinge which will allow a lid to be held open without the use of a counterpoise spring.

Accordingly the present invention provides a hinge as defined in the claims appearing hereinafter.

Embodiments of the invention will now be described by way of example only with reference to the accompanying drawings in which.

Figure 1:
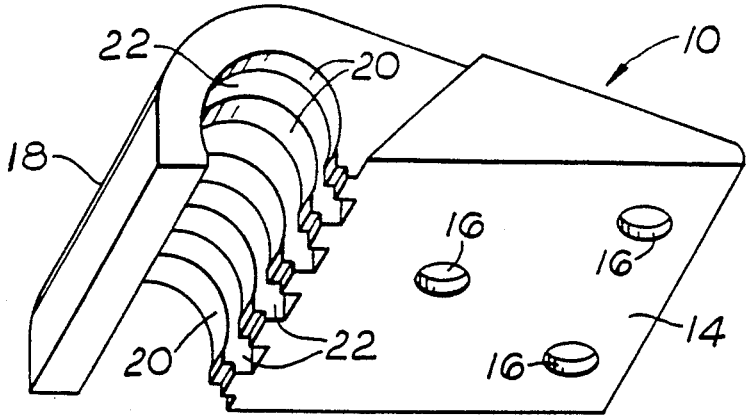
FIG. 1 is a perspective view of a body component.
Figure 2:
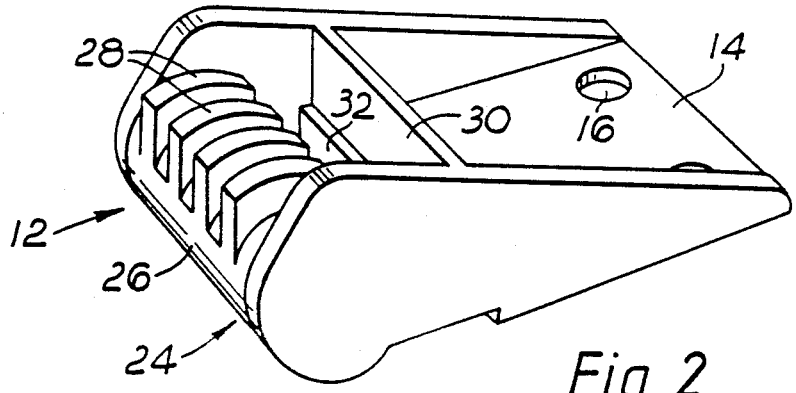
FIG. 2 is a perspective view of a lid component.

Referring to FIGS. 1 and 2, the hinge comprises a body component 10 which is integrally moulded from polypropylene and a lid component 12 which is integrally moulded from ABS. Each of the components 10 and 12 is provided with a plate-like portion 14 having holes 16 for fastening means, such as self-tapping screws.

The body component 10 has an end portion 18 of generally part-cylindrical form whose interior is moulded to provide a number of ribs having inside faces 20 providing a part-cylindrical bearing surface and defining four circumferential grooves 22.

The lid component 12 has an end portion 24 comprising a solid cylindrical part 26 from which extend four blades 28.

Figure 3:
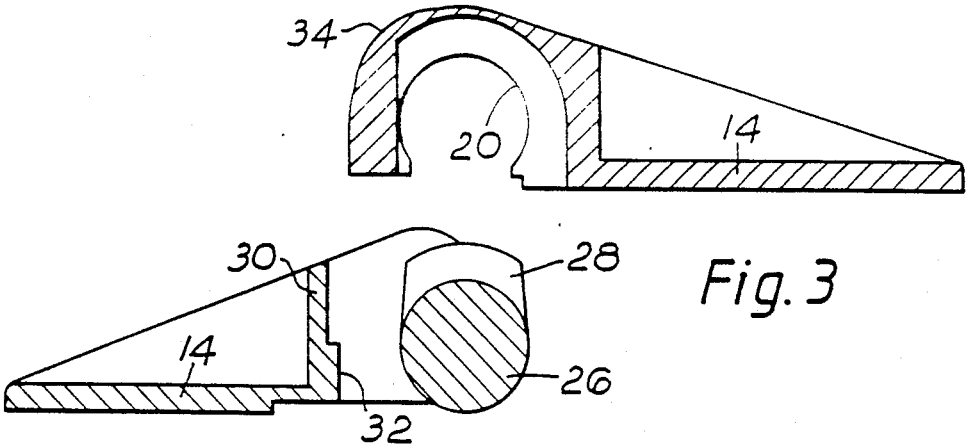
FIG. 3 is a side view illustrating the assembly of the hinge.
Figure 4:
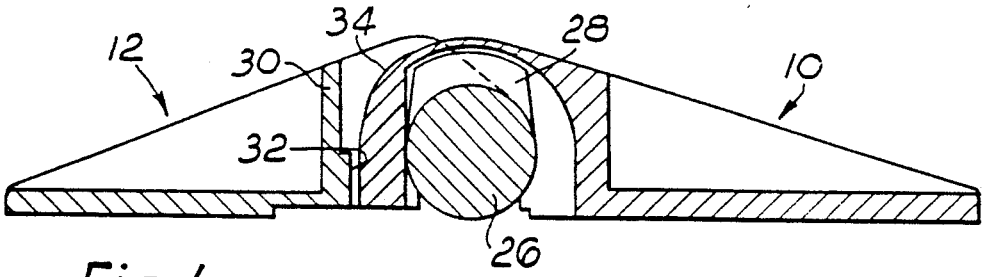
FIG. 4 is a side view of the hinge in the closed position.

Turning to FIG. 3, the hinge can be assembled by orienting the parts 10 and 12 as shown and forcing them together. Since the bearing surface 20 extends over more than 180° the cylindrical part 26 becomes trapped therein as shown in FIG. 4. This arrangement makes the hinge particularly suited to automatic assembly methods.

Figure 5:
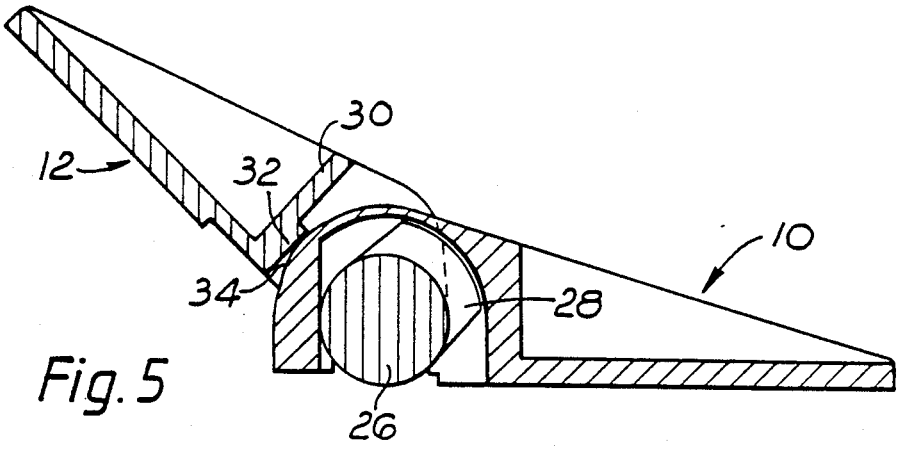
FIG. 5 is a side view of the hinge in a partially open position.
Figure 6:
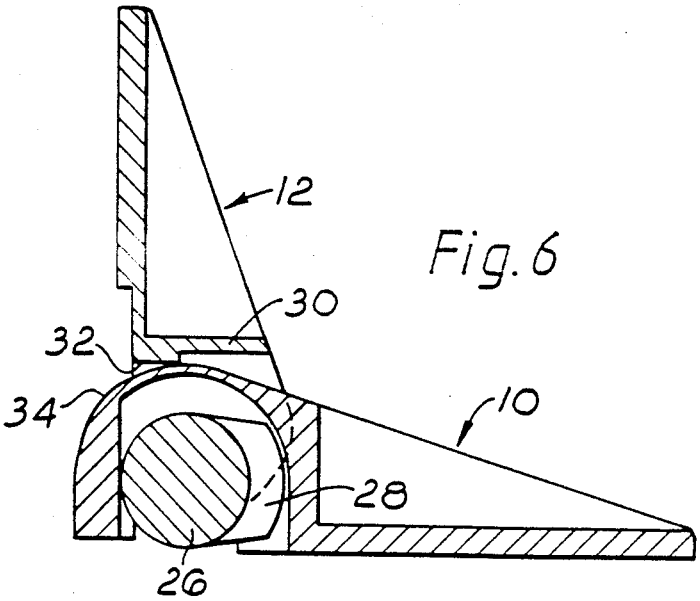
FIG. 6 is a side view of the hinge in a fully open position.

In this assembled condition, the blades 28 are positioned within the grooves 22 to provide mutual engagement as discussed in more detail below. The lid component 12 has a transverse wall portion 30 which includes a protrusion 32. The outer surface of the body component end portion 18 is of part-cylindrical shape but is provided with a convex protrusion 34. The protrusions 32 and 34 are positioned and dimensioned such that they engage with each other over an opening arc from the 40° position shown in FIG. 5 to a 60° position to retain the lid open.

Preferably the blades 28 and grooves 22 are also arranged to provide engagement over an opening arc between 40° and 90°. This angle of engagement may be provided by suitable shaping of the thickness of the blades 28 and/or the grooves 22, or by the provision of protrusions on one or other of these at appropriate angular spacings.

The engagement between the protrusions 32 and 34, and that between the blades 28 and grooves 22, is partly of a frictional nature since the relevant surfaces are in running contact. Additionally, however, the parts are so dimensioned that the interengagement causes electric deformation; this produces a high degree of force akin to a spring force opposing closing movement, eg closing movement of a lid under gravity.

The hinge of this embodiment therefore rotates freely from the closed position to the 40° position. Between 40° and 60° (where the closing effect of the weight of the lid is greatest) a relatively high frictional resistance is provided by the protrusions 32 and 34 acting as a primary friction pad plus the blades and grooves 28, 20 acting as a secondary friction pad, and between 60° and 90° a relatively lower degree of friction is provided by the secondary friction pad only.

Figure 7:
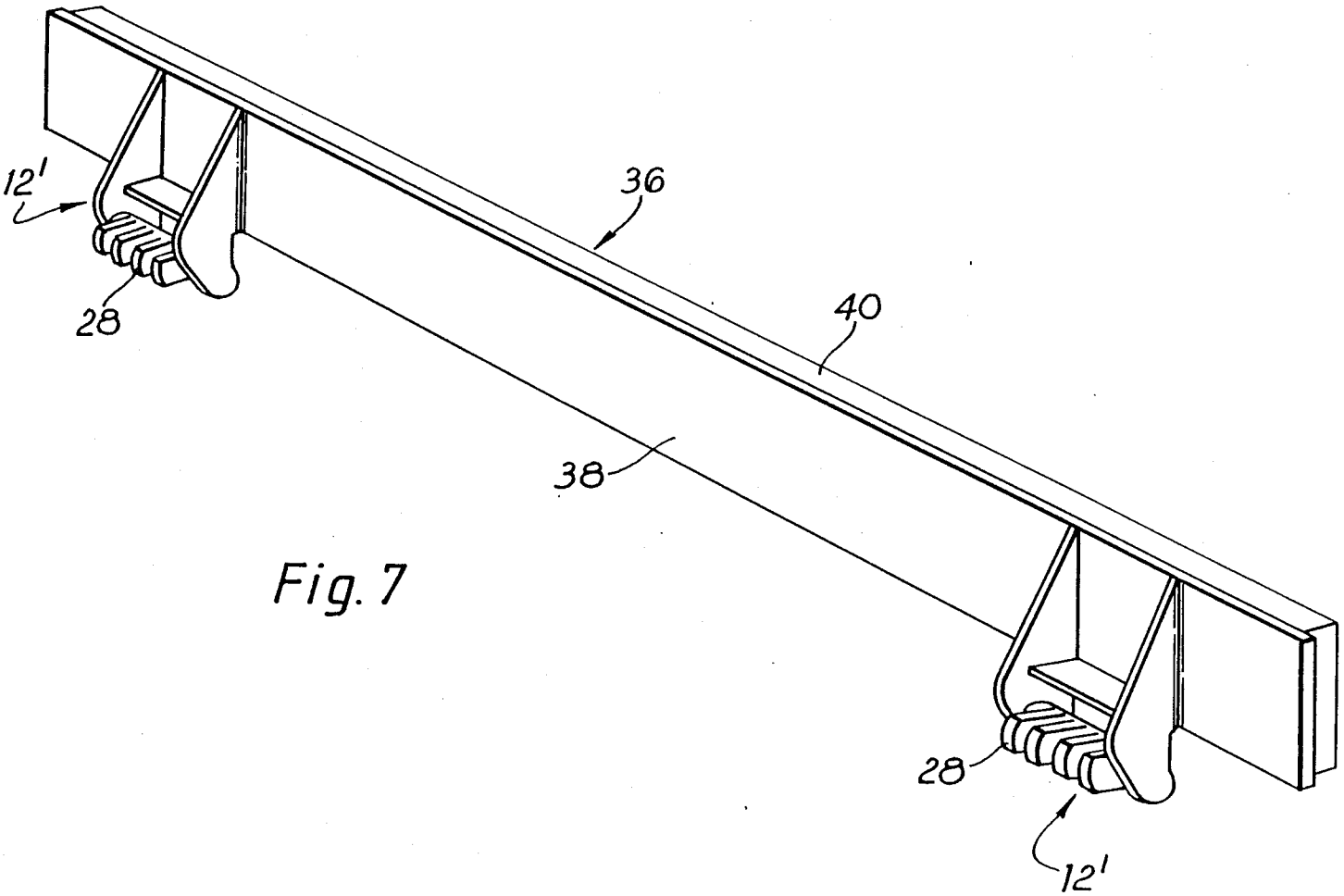
FIG. 7 is a perspective view showing part of a hinge arrangement in accordance with another embodiment.

FIG. 7 illustrates a modified embodiment in which two lid components 12', each substantially similar to the lid components 12 of the first embodiment, are formed integrally as part of a moulding 36. The moulding 36 has a plane outer surface 38 and an internal flange 40 which can be received within a box-like lid such that the moulding 36 forms an end cap for the lid. This moulding 36 can be used with the body components 10 of FIGS. 1–6.

What is claimed is:

1. A hinge comprising:

a first component (10) and a second component (12), each having a first portion (14) for attachment to a respective structure;

the first component (10) having a second portion (18) shaped to provide a concave bearing surface (20) of generally part-cylindrical form extending over an arc greater than 180°;

the second component (12) having a second portion (24) presenting a convex generally cylindrical surface (26) of a diameter matching that of said bearing surface (20);

said second portion (18) of the first component (10) being arranged to receive said second portion (24) of the second component (12) in a snap-fit manner with said surfaces in engagement;

wherein said components (10, 12) are also provided with formations (28, 32; 22, 34) which interengage over a predetermined part of an opening arc of the hinge in such a manner as to produce elastic deformation thereby providing a frictional force tending to maintain the first and second components in any selected position relative to one another within said predetermined part of the opening arc, and wherein, said interengaging formations comprise first formations (32, 34) which interengage only over a first arc and second formations (22, 28) which interengage over said first arc and additionally over a second arc, wherein one of said first formations is disposed upon a convex outer surface of said first component and one of said second formations is disposed upon said concave bearing surface of said first component.

2. The hinge of claim 1, in which each component (10, 12) is a one-piece plastics moulding.

3. The hinge of claim 1, in which said first formations comprise a convex protuberance (34) formed on a part-cylindrical outer surface of said second portion (18) of the first component (10) and a protuberance (32) formed on the second component (12), wherein said convex protuberance is said one of said first formations.

4. The hinge of claim 1, in which said second formations comprise at least one blade (28) extending radially from said convex surface (26) of said second component (12), and said one of said second formations comprising a groove (22) in said bearing surface (20 in which the blade engages over said first and second arcs.

5. A hinge according to any one of the preceding claims, in which the second component (12') is moulded integrally with a structural member (36) an additional like second component (12') also being moulded integrally therewith form part of a second hinge.

* * * * *